United States Patent [19]

Hsieh

[11] Patent Number: 4,648,966

[45] Date of Patent: Mar. 10, 1987

[54] PROCESS FOR BENEFICIATION OF DOLOMITIC PHOSPHATE ORES

[75] Inventor: Shaung-shii Hsieh, Florence, Ala.

[73] Assignee: Tennessee Valley Authority, Muscle Shoals, Ala.

[21] Appl. No.: 803,690

[22] Filed: Dec. 2, 1985

[51] Int. Cl.[4] ..... B03D 1/06; B03D 1/10

[52] U.S. Cl. ..... 209/167; 209/166

[58] Field of Search ..... 209/167, 166, 902

[56] References Cited

U.S. PATENT DOCUMENTS

| | | | |
|---|---|---|---|
| 2,293,640 | 8/1942 | Crage | 209/166 |
| 3,462,016 | 8/1969 | Bushell | 209/166 |
| 4,144,969 | 3/1979 | Snow | 209/166 |
| 4,189,103 | 3/1979 | Snow | 209/166 |
| 4,287,053 | 9/1981 | Lehr | 209/167 |
| 4,289,612 | 9/1981 | Schrieber | 209/166 |
| 4,317,715 | 3/1982 | Hintikka | 209/167 |
| 4,324,653 | 4/1982 | Henchiri | 209/167 |
| 4,364,824 | 12/1982 | Snow | 209/167 |
| 4,392,843 | 2/1983 | Lawver | 209/166 |
| 4,425,229 | 1/1984 | Baron | 209/166 |
| 4,436,616 | 3/1984 | Dufour et al. | 209/166 X |
| 4,486,301 | 12/1984 | Hsieh | 209/167 |
| 4,565,625 | 1/1986 | Hsieh | 209/167 |
| 4,584,096 | 4/1986 | Lilly | 209/166 |

FOREIGN PATENT DOCUMENTS

| | | | |
|---|---|---|---|
| 529433 | 8/1956 | Canada | 209/166 |

*Primary Examiner*—S. Leon Bashore

*Assistant Examiner*—Thomas M. Lithgow

*Attorney, Agent, or Firm*—Robert A. Petrusek

[57] ABSTRACT

An improved phosphate ore beneficiation process wherein phosphate ore containing coarse, weathered dolomite in the flotation feed thereof is subjected to beneficiation as follows: The flotation feed is subjected to a rougher phosphate flotation step wherein it is treated with fatty acid and fuel oil and wherefrom is removed the coarse, weathered dolomite in one or more subsequent cleaner phosphate flotation steps without the use of additional flotation reagents added thereto; subjecting the float from said cleaner phosphate flotation step(s) to a sulfuric acid based partial deoiling step and then to a phosphate-carbonate flotation step wherefrom is collected a first fraction of the phosphate flotation feed values as underflow subjecting the overflow from said phosphate-carbonate flotation step to a sulfuric acid based total deoiling step wherefrom the resulting deoiled material from said total deoiling step is subsequently introduced and subjected to carbonate flotation step(s) using alkyl diphosphonic acid as a phosphate mineral depressant and fatty acid as a carbonate mineral collector; and recovering a second fraction of the phosphate values from said carbonate flotation as underflow. The final phosphate product is the sum total of said first fraction and said second fraction of phosphate values as concentrate from recovered said phosphate-carbonate flotation step and said carbonate flotation step(s) respectively.

2 Claims, 2 Drawing Figures

PROCESS FOR BENEFICIATION OF DOLOMITIC PHOSPHATE ORES

INTRODUCTION

The present invention relates to a phosphate ore beneficiation process and more particularly, the present invention relates to an improved process for beneficiating phosphate ores containing coarse, weathered dolomite in the flotation feed thereof.

RELATED APPLICATIONS

The teachings of the instant disclosure are in the nature of an improvement over the invention taught in my copending application Ser. No. 785,310 filed Oct. 7, 1985 and assigned to the assignee of the present invention.

BACKGROUND OF THE INVENTION

1. Field of the Invention

Current beneficiation practices for phosphate ores commonly utilize flotation as the principal step for separating phosphates from gangue minerals. The "Crago" or "double float" froth flotation process is commercially used for beneficiating such phosphate ores in which silica and silicate minerals are the predominant constituents of gangues. That process consists of conditioning the material with fatty acids and fuel oil, flotation of phosphate minerals, deoiling with sulfuric acid to remove the reagents, and refloating with amine reagents to remove the siliceous gangue which either floated or was trapped in the rougher float (U.S. Pat. No. 2,293,640 Crago, Aug. 18, 1942).

Unfortunately, from a chemical processing standpoint, many phosphate ores of potential commercial value contain carbonate gangue mineral matter in addition to such siliceous minerals. These carbonate mineral impurities include dolomite, calcite, dolomitic limestone, seashell, and other less common carbonate-type minerals. Such mineral impurities not only dilute the $P_2O_5$ content of the phosphate ore concentrate, but also may interfere in subsequent chemical processing thereof. For example, carbonate minerals present in phosphate ore concentrates used to produce phosphoric acid, superphosphate, or triple superphosphate consume acid reagents in the acidulation steps without providing additional fertilizer values thereto. Such carbonate minerals also aggravate foam formation in reactor vessels. The presence of dolomite or dolomitic limestone in the phosphate ore concentrate is oftentimes of particular importance because relatively small amounts of magnesium (i.e. $>1$ percent MgO) may cause technical problems in current wet-process acid chemical plants due to increased viscosity of acid, increased defoamer usage, scale and sludge formation, and possibly difficulty in maintaining a standard diammonium phosphate (DAP) fertilizer grade.

Because of these, as-well-as other considerations the "double float" process has generally been considered ineffective for beneficiating such high carbonate phosphate ores. Collectors, such as fatty acids used for phosphate minerals, generally float the carbonate minerals as well, and it is only by the employment of suitable selective depressants of either phosphate or carbonate gangue that any degree of adequate selectivity can be obtained.

2. Description of the Prior Art

Numerous and sundry methods of beneficiating phosphate ores containing carbonate and siliceous gangue materials are described in the following U.S. Pat. Nos.: 3,259,242, Snow, July 1966; 3,462,016, Bushell et al, August 1969; 3,462,017, Bushell et al, August 1969; 3,807,556, Johnston, May 1974; 4,144,969, Snow, March 1979; 4,189,103, Lawver et al, February 1980; 4,287,053, Lehr et al, September 1981; 4,317,715, Hintikka et al, March 1982; 4,364,824, Snow Dec. 21, 1982; and 4,372,843, Lawver et al, February 1983. Each of these patents deals with processes that differ from the present invention, as for example: Snow, in U.S. Pat. No. 3,259,242 supra describes the beneficiation of a macrocrystalline apatite-calcite mixture which utilizes a cationic flotation to collect apatite as a float concentrate. Bushell et al, in U.S. Pat. No. 3,462,016 supra, teaches the use of $H_3PO_4$ and Bushell et al in U.S. Pat. No. 3,452,017 supra teach the use of $NH_4H_2PO_4$, both as phosphate mineral depressants for beneficiating carbonate-bearing phosphate rock. Johnston, in U.S. Pat. No. 3,807,556 supra further teaches the use of soluble sulfate salts such as $Na_2SO_4$ or $(NH_4)_2SO_4$ to reduce the loss of soluble phosphate which in turn occurs in the practice of the processes described in '016 and '017 supra.

The use of an apatite-collecting cationic reagent and a liquid hydrocarbon is described in '969 and '103 supra. The teachings in these patents describe a phosphate ore beneficiating process in which the deslimed ore is first subjected to a "double float" froth flotation as described in '640, Crago, supra, to remove siliceous gangue. The float product containing apatite with dolomite impurities is then conditioned with a cationic agent and a liquid hydrocarbon to concentrate apatite as float.

Hintikka et al, in '715 supra describe two alternative processes to separate phosphate minerals from carbonate minerals after phosphate and carbonate minerals are concentrated from silicates; (1) the combined phosphate-carbonate concentrate is treated with a base, whereafter phosphate mineral is floated with a cationic collector, or (2) the combined phosphate-carbonate concentrate is treated with $SO_2$ or $CO_2$ to recover phosphate as a float.

The disclosures in '824 and '843 supra, describe a flotation process for removing carbonate mineral impurities. The methods employ salts of sulfonated linear fatty acids as a carbonate mineral collector and a phosphate depressant, such as polyphosphate, metaphosphate, pyrophosphate or orthophosphate, to remove carbonate minerals in the overflow and to collect the phosphate concentrate in the underflow.

Lehr et al in '053 supra, assigned to the assignee of the present invention, describe a phosphate ore beneficiating process in which phosphate ores containing carbonate mineral impurities are subjected to froth flotation in the presence of phosphate depressants, said depressants comprising alkyl diphosphonic acids, and a carbonate collector, said collector comprising fatty acids, removing the separated carbonate minerals from the overflow, and recovering the phosphate value in the underflow.

Lehr et al supra also teach that, in practicing their flotation method, the phosphate ores containing siliceous gangues preferably is first beneficiated by conventional techniques, such as the "double float" or "Crago" froth flotation process, to concentrate the phosphate values. Subsequently, the phosphate concentrate containing carbonate mineral impurities is subjected to a final stage of flotation employing the method of the said invention to remove carbonate minerals and produce a salable product. See for example, '053 supra, column 2, lines 16–24.

This method of Lehr et al works well when dolomite is unweathered and evenly distributed in the different size fractions of the flotation feed, or when the dolomite content is particularly high in the fine-size fractions (for example, −100 +150 mesh, −150 +200 mesh, −200 +270 mesh, etc.). However, their method is fraught with difficulties when applied to some phosphate ores containing coarse, weathered dolomite in the flotation feed, such as that from Central and South Florida. A phosphate concentrate having satisfactory $P_2O_5$ grade and MgO content cannot be obtained with reasonable recovery efficiency using the conventional Crago process, followed by Lehr's diphosphonic acid depressant process. The coarse, weathered dolomite carried over from the phosphate rougher flotation of the Crago process was found to be difficult to float in the carbonate flotation stage using Lehr's work.

In copending application Ser. No. 785,310 filed Oct. 7, 1985 the present applicant teaches a phosphate ore beneficiation process wherein phosphate ore containing coarse, weathered dolomite in the flotation feed thereof is subjected to beneficiation as follows: The flotation feed is sent to a rougher phosphate flotation step wherein it is treated with fatty acid and fuel oil and wherefrom is removed the coarse, weathered dolomite in one or more cleaner phosphate flotation step(s) without the use of additional flotation reagents. After deoiling with sulfuric acid to remove the fatty acid and fuel oil the residual silica is removed from the phosphate concentrate with amine if necessary. The resulting phosphate concentrate is then subjected to carbonate flotation using alkyl diphosphonic acid as a phosphate mineral depressant and fatty acids as a dolomite collector. The phosphate values are recovered in the underflow from said carbonate flotation. The metallurgical results obtained from following the teachings of this copending application method are excellent.

The present invention teaches still further an improved process for beneficiating phosphate ore containing coarse, weathered dolomite in the flotation feed. The teachings of the instant invention introduces the use of two additional steps, ie., (1) partial deoiling; and (2) phosphate-carbonate flotation, to the steps comprising the improvement in my copending application, supra. These new steps will reduce by more than half of the reagent consumption, such as fatty acid and alkyl diphosphonic acid in the subsequent carbonate flotation circuit. Furthermore, in the practice of the instant invention the sulfuric acid consumption will also be significantly reduced. The grade of product produced and the $P_2O_5$ recovery will be the same or even better than is obtained in the processes described and taught in my copending application, supra.

SUMMARY OF THE INVENTION

The present invention is directed to an effective beneficiation process for upgrading a phosphate ore containing coarse, weathered dolomite in the flotation feed. The said flotation feed may be either (1) the regular flotation feed fraction prepared from the weathered dolomitic phosphate ore by the conventional washing and sizing methods, or (2) the flotation feed prepared from the pebble size fraction of weathered dolomitic phosphate ore by conventional grinding and sizing methods known in the art. The method of the subject invention includes the steps of:

(a) conditioning the flotation feed at about a pH ranging from about 8.5 to about 10 with about 0.3 kg to about 2 kg fatty acid and upwards to about 4 kg fuel oil per ton of feed (feed as herein and subsequently indicated is amount of feed used in the rougher flotation stage);

(b) collecting the phosphate values and some silica and dolomite impurities as rougher concentrate from the overflow;

(c) subjecting the rougher concentrate to one or more cleaner flotation step(s) without the requirement of additional flotation reagents added thereto, and rejecting coarse, weathered dolomite and some silica in the underflow;

(d) partially deoiling (in partially removing the fatty acid and fuel oil from) the cleaner phosphate concentrate of step (c) supra with from about 0.05 kg to about 0.5 kg of $H_2SO_4$ added per ton of feed;

(e) subjecting the resulting partial deoiled phosphate concentrate from step (d) supra to a phosphate-carbonate flotation step and recovering in the underflow therefrom, a first fraction of phosphate concentrate;

(f) subjecting the float from step (e) supra to total a deoiling step with from about 0.07 to about 0.7 kg $H_2SO_4$ added per ton of feed;

(g) subjecting the resulting deoiled phosphate concentrate (which contains fine dolomite particles) to carbonate flotation step(s) in a flotation circuit in the presence of from about 0.015 kg to about 0.2 kg alkyl diphosphonic acid per ton of feed as a phosphate mineral depressant and from about 0.025 kg to about 0.5 kg fatty acid per ton of feed as a dolomite collector is maintained, thereafter removing the resulting separated dolomite as waste in the overflow therefrom, and recovering in the underflow therefrom a second fraction of phosphate concentrate; and (h) combining said first fraction of phosphate concentrate from step (e) supra and said second fraction of phosphate concentrate from step (g) as final phosphate product.

The gist underling the concept of the instant invention as a further improvement over the advances of the art set forth in copending application, supra, is that the practice of steps (d) and (e) supra results in a recovery about one-half of the phosphate concentrate and "sets up" the remaining material for further beneficiation in a mode such that the reagent consumption in step (g) can be reduced by about one-half or more. Additionally, in practicing the present invention, silica flotation with amine can be introduced between steps (f) and (g), or between steps (g) and (h), or after step (h) if the amount of silica present in the phosphate concentrate is significant.

BRIEF DESCRIPTION OF THE DRAWINGS

The present invention will be better understood from a consideration of the following description taken in connection with the accompanying drawings in which.

DETAILED DESCRIPTION OF THE INVENTION INCLUDING THE PREFERRED EMBODIMENTS IN CONJUNCTION WITH DETAILED DESCRIPTIONS OF THE FIGURES

The present invention provides an improved beneficiating process for concentrating phosphate values from a phosphate ore containing coarse, weathered dolomite in the flotation feed, such as that found in sedimentary deposits in Central and South Florida. Said flotation feed can be the regular flotation feed fraction prepared from the weathered dolomitic phosphate ore by the conventional washing and sizing methods, or the flotation feed prepared from the pebble size fraction of weathered dolomitic phosphate ore by conventional grinding and sizing techniques known in the art. A particle size smaller than about 28 mesh is preferably used as the flotation feed for the present process. With larger particle size, an appreciable amount of the gangue minerals may remain locked with the apatite. Furthermore, the larger particles are difficult to float, not only for dolomite, but also for phosphate minerals. Very small particles, e.g., smaller than about 400 mesh, are removed by a desliming process. Although the slime may contain phosphate value, their relatively large consumption of reagents make their beneficiation economically unattractive in relation to recoverable values of $P_2O_5$.

Figure 1:
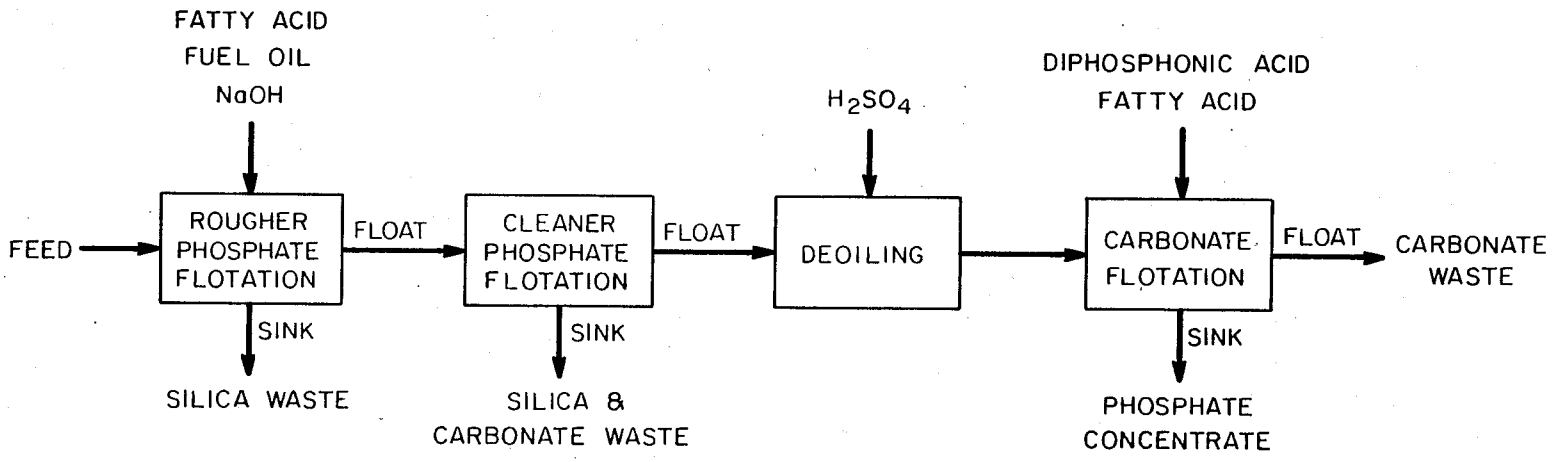
FIG. 1 is a flowsheet illustrating the preferred flotation procedures utilized and set forth in my copending application, supra. The flotation feed is first subjected to rougher phosphate flotation with fatty acid, fuel oil, and NaOH. The rougher float from the rougher flotation step is subsequently returned to the flotation cell and subjected to one or more cleaner phosphate flotation step(s) wherein the coarse, weathered dolomite and some silica carried over from the rougher phosphate flotation step are rejected in the underflow. The float carrying the bulk of the phosphate values is then subjected to deoiling with sulfuric acid and subsequently subjected to a carbonate flotation step(s) with alkyl diphosphonic acid used as a phosphate depressant and fatty acid utilized as a dolomite collector therein. The dolomite is rejected in the overflow and the phosphate values are recovered in the underflow. Although this improved beneficiation process offers a significant advancement of the art as described in my copending application, supra, I have now discovered that a significant reduction on reagent consumption can be realized as shown in the description of instant invention when my two new additional steps of (1) partial deoiling; and (2) phosphate-carbonate flotation are incorporated into said prior described process.

A technically effective beneficiating process has been recently developed by applicant and presented in his copending application, '310, supra. The flotation scheme and procedure used therein is shown in FIG. 1. The prepared flotation feed, which is about −28 and +400 mesh in size, is first subjected to rougher phosphate flotation and is similar to that performed in the conventional Crago process. The flotation feed is conditioned at a pH ranging from about 8.5 to about 10 with from about 0.3 kg to about 2 kg fatty acid and ranging upwards to about 4 kg fuel oil per ton of feed. The phosphate values along with some silica and dolomite impurities are then collected from the overflow. The rougher concentrate from the rougher flotation stage is returned to the flotation cell and subjected to one or more cleaner flotations in the cleaner phosphate flotation step(s) wherein the coarse, weathered dolomite and some silica carried over from the rougher phosphate flotation step(s) are rejected in the underflow. The phosphate concentrate from the cleaner phosphate flotation step(s) is further deoiled with about 0.2 kg to about 2 kg $H_2SO_4$ per ton of feed to remove the fatty acid and fuel oil reagents. Finally, the phosphate concentrate which still contains significant amounts of fine dolomite particles is subjected to carbonate flotation wherein from about 0.03 kg to about 0.4 kg alkyl diphosphonic acid per ton of feed as a phosphate mineral depressant and from about 0.1 kg to about 2 kg fatty acid per ton of feed as a dolomite collector. The fine dolomite particles are rejected as waste from the overflow and the phosphate concentrate is recovered as final product from the underflow.

Figure 2:
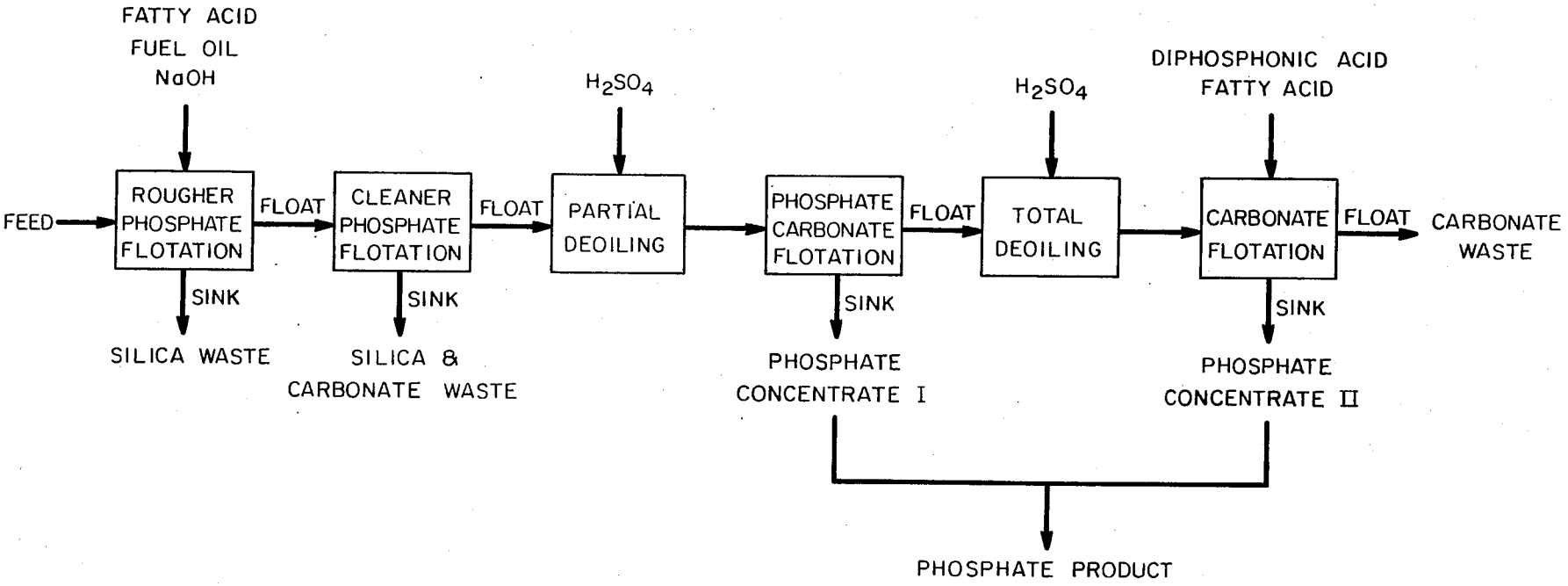
FIG. 2 is a flowsheet illustrating the principals of the instant invention and depicts the flotation procedure used therein. As may be seen the flotation feed, as usual, is subjected to rougher phosphate flotation and one or more cleaner phosphate flotation step(s). As differing from the prior art in general and the disclosure and teachings of my copending application, supra, the phosphate concentrate (still containing some dolomite) from the cleaner phosphate step is subjected to partial deoiling with sulfuric acid wherein the amount of acid used is less than that required for conventional deoiling. The resulting partial deoiled pulp is then subjected to a phosphate-carbonate flotation step wherein most of carbonate mineral and part of phosphate mineral is removed as float for further processing and part of phosphate values are recovered as a first fraction in the underflow. The float from the phosphate-carbonate flotation step(s) is then subjected to conventional deoiling (or total deoiling as shown and referred to in FIG. 2) and subsequently introduced to a carbonate flotation step(s) with alkyl diphosphonic acid and fatty acid as described, supra. Additional phosphate values are then recovered as a second fraction from the underflow and combined with the previous phosphate concentrate from the phosphate-carbonate flotation step in the first fraction as the final phosphate product with the carbonate waste being rejected in the overflow.

The general flotation procedure used in the present invention is shown in FIG. 2. This instant invention introduces additional steps, to wit (1) partial deoiling; and (2) phosphate-carbonate flotation after the cleaner phosphate flotation step wherefrom the consumption of diphosphonic acid and fatty acid in the subsequent carbonate flotation will be reduced by about one-half or more. The consumption of $H_2SO_4$ used in this new process is also reduced.

In practicing the present invention, the prepared flotation feed is first subjected to rougher phosphate flotation and then to one or more cleaner phosphate flotations in a manner similar to that performed in the copending application process, supra. The gist of the present invention, which differs from the prior art, is that the float from the cleaner phosphate flotation step is first subjected to a partial deoiling step with about 0.05 kg to about 0.5 kg $H_2SO_4$ per ton of feed and then to phosphate-carbonate flotation step to recover about one-third to two-thirds of final phosphate concentrate in the underflow. The float from phosphate-carbonate flotation step is then subjected to total deoiling with about 0.07 kg to about 0.7 kg $H_2SO_4$ per ton of feed. This resulting deoiled material is finally subjected to carbonate flotation wherein about 0.015 kg to about 0.2 kg alkyl diphosphonic acid per ton of feed is used as a phosphate mineral depressant and about 0.05 kg to about 1 kg fatty acid per ton of feed is used as a carbonate mineral collector, removing the separated dolomite as waste from the overflow, and recovering the other one-third to two-thirds of final phosphate values from the underflow. The phosphate concentrate from phosphate-carbonate step and from carbonate flotation step is then combined as the final phosphate product.

EXAMPLES

The present invention is further illustrated by the following examples. In order that those skilled in the art may better understand how the present invention can be practiced, the following examples are given by way of illustration and not necessarily by way of limitation. It is noted that Examples I and II herein are offered in the manner of comparative examples, in that they illustrate what happens when the process of the instant invention is practiced without the use of applicants two new steps of (1) partial deoiling; and (2) phosphate-carbonate flotation.

EXAMPLE I

A Florida phosphate ore containing weathered dolomite in the pebble fraction was used in this example. The pebble fraction, which contained undesirable dolomite mineral, was stage-ground in a rod mill to prepare a minus 28- plus 400-mesh flotation feed. This feed contained about 37 percent CaO, 22.3 percent $P_2O_5$, 1.9 percent MgO and 24 percent $SiO_2$, and about 58 percent of total MgO content was presented in the plus 65-mesh fraction.

In this example, the flotation feed was processed by means of the steps of the method shown in FIG. 1, wherein said feed was subjected to rougher phosphate flotation, cleaner phosphate flotation, deoiling and carbonate flotation.

In this flotation experiment, a 500-gram flotation feed was conditioned at a pulp density of 65 percent for 2.5 minutes with from about 0.75 kg fatty acid and about 1.5 kg fuel oil per ton of feed. The pH was adjusted to 9.3 with NaOH. The pulp then was diluted with tap water and floated to recover the phosphate values in the rougher float and to remove silica as waste in the rougher sink.

After the rougher phosphate flotation, the rougher phosphate concentrate was returned to the flotation cell, diluted with tap water and refloated with the phosphate minerals in the float and the rejected coarse, weathered dolomite and some silica in the sink. The same cleaner phosphate flotation procedure was repeated once to remove additional coarse dolomite as waste. After the second cleaner phosphate flotation step the phosphate concentrate was subjected to deoiling with $H_2SO_4$ at a rate of 1.5 kg per ton of feed. No silica flotation with amine was performed, because most of the free silica had been removed in the rougher and cleaner phosphate flotation. The deoiled phosphate concentrate was then subjected to carbonate flotation with 0.15 kg hydroxyethylidene diphosphonic acid (60% active content) and 1.5 kg oleic acid per ton of feed. The conditioning pH at the carbonate separation circuit was 5.4. The flotation results are shown in Table I infra. The final phosphate product contained 30.4 percent $P_2O_5$ and only 0.8 percent MgO. The $P_2O_5$ recovery was 81.4 percent.

TABLE 1

| Product | Analysis, % | | | | | Distribution, % | | | |
|---|---|---|---|---|---|---|---|---|---|
| | Wt % | CaO | $P_2O_5$ | MgO | $SiO_2$ | CaO | $P_2O_5$ | MgO | $SiO_2$ |
| Rougher phosphate flotation | 20.9 | 10.1 | 3.8 | 2.6 | 78.2 | 5.8 | 3.6 | 29 | 67.9 |
| Rougher sink | | | | | | | | | |
| Cleaner phosphate flotation | | | | | | | | | |
| First cleaner sink | 7.1 | 23.1 | 11.2 | 3.7 | 45.8 | 4.5 | 3.6 | 14 | 13.5 |
| Second cleaner sink | 4.6 | 31.6 | 16.9 | 3.8 | 30.1 | 4.0 | 3.5 | 9 | 5.8 |
| Carbonate flotation | | | | | | | | | |
| Carbonate float | 7.8 | 44.1 | 22.7 | 5.2 | 3.7 | 9.3 | 7.9 | 22 | 1.2 |
| Phosphate sink | 59.6 | 46.9 | 30.4 | 0.8 | 4.7 | 76.4 | 81.4 | 26 | 11.6 |
| Head (Calculated) | 100.0 | 36.6 | 22.3 | 1.9 | 24.1 | 100.0 | 100.0 | 100 | 100.0 |

EXAMPLE II

The phosphate ore flotation feed and flotation procedure were the same as that outlined in Example I supra except that the oleic acid used in the carbonate flotation stage was at the rate of 1.0 kg per ton of feed, and the conditioning pH was held at 5.6. The flotation results are shown in Table II infra. Note that the recovered phosphate product contained 30.3 percent $P_2O_5$ and 0.9 percent MgO; the $P_2O_5$ recovery was 85.7 percent.

TABLE II

| Product | Analysis, % | | | | | Distribution, % | | | |
|---|---|---|---|---|---|---|---|---|---|
| | Wt % | CaO | $P_2O_5$ | MgO | $SiO_2$ | CaO | $P_2O_5$ | MgO | $SiO_2$ |
| Rougher phosphate flotation | 19.3 | 9.8 | 3.8 | 2.5 | 78.4 | 5.1 | 3.3 | 25 | 63.1 |
| Rougher sink | | | | | | | | | |
| Cleaner phosphate flotation | | | | | | | | | |
| First cleaner sink | 5.6 | 18.0 | 8.8 | 3.2 | 58.0 | 2.7 | 2.2 | 9 | 13.5 |
| Second cleaner sink | 3.3 | 25.0 | 13.5 | 3.2 | 43.9 | 2.2 | 1.9 | 5 | 6.0 |
| Carbonate flotation | | | | | | | | | |
| Carbonate float | 8.3 | 41.6 | 18.7 | 7.2 | 4.3 | 9.3 | 6.9 | 31 | 1.5 |
| Phosphate sink | 63.6 | 47.2 | 30.3 | 0.9 | 6.0 | 80.7 | 85.7 | 30 | 15.9 |
| Head (Calculated) | 100.1 | 37.2 | 22.5 | 1.9 | 24.0 | 100.0 | 100.0 | 100 | 100.0 |

EXAMPLE III

In the tests comprising this example the phosphate ore flotation was performed according to the procedure shown in FIG. 2. The initial flotation feed used was 1000 g. The detailed flotation conditions were the same as outlined in Example I, supra, up to the end point of the cleaner phosphate flotations. After the cleaner phosphate flotations (also performed twice), the float was returned to the flotation cell and combined with $H_2SO_4$ at the rate of 0.3 kg per ton of feed as partial deoiling agent. The pulp was conditioned for 2.5 minutes and then subjected to phosphate-carbonate flotation to recover part of phosphate values as sink (Phosphate concentrate I in FIG. 2). The float from the phosphate-carbonate flotation step was then subjected to total deoiling with $H_2SO_4$ at the rate of 0.5 kg per ton feed. After desliming at about 400 mesh, the deoiled sample was then subjected to carbonate flotation wherein the feed (65 percent solids) was conditioned with hydroxyethylidene diphosphonic acid (60 percent active content) at the rate of 0.075 kg per ton of feed for 1 minute and then with oleic acid at the rate of 0.38 kg per ton of feed for 2.5 minutes. The conditioning pH was maintained at 6.0. After conditioning, the pulp was then diluted with tap water and floated to reject the carbonate waste in the overflow and to recover additional phosphate value in the sink (phosphate concentrate II in FIG. 2). The phosphate concentrates I and II were combined as final phosphate product. The flotation results are shown in Table III infra. The recovered phosphate product contained 30.5 percent $P_2O_5$ and 0.7 percent MgO; the $P_2O_5$ recovery was 84.6 percent.

TABLE III

| Product | Analysis, % | | | | | Distribution, % | | | |
|---|---|---|---|---|---|---|---|---|---|
| | Wt % | CaO | $P_2O_5$ | MgO | $SiO_2$ | CaO | $P_2O_5$ | MgO | $SiO_2$ |
| Rougher phosphate flotation | 19.3 | 9.9 | 3.9 | 2.4 | 75.6 | 5.3 | 3.4 | 26 | 63.3 |
| Rougher sink | | | | | | | | | |
| Cleaner phosphate flotation | | | | | | | | | |
| First cleaner sink | 7.3 | 20.4 | 10.4 | 3.3 | 52.6 | 4.0 | 3.4 | 13 | 16.4 |
| Second cleaner sink | 3.7 | 27.2 | 14.7 | 3.5 | 37.9 | 2.7 | 2.4 | 7 | 6.0 |
| Phosphate-carbonate flotation | 23.4 | 45.5 | 29.4 | 0.8 | 7.4 | 29.0 | 30.6 | 10 | 7.4 |
| Phosphate concentrate I | | | | | | | | | |
| Carbonate flotation | | | | | | | | | |
| Carbonate float | 7.2 | 40.6 | 19.4 | 7.3 | 2.9 | 7.9 | 6.2 | 29 | 0.9 |
| Phosphate concentrate II | 38.9 | 48.3 | 31.2 | 0.7 | 3.6 | 51.1 | 54.0 | 15 | 6.0 |
| Head (Calculated) | 100.0 | 36.8 | 22.5 | 1.8 | 23.3 | 100.0 | 100.0 | 100 | 100.0 |
| Phosphate Product (Calculated) | 62.3 | 47.3 | 30.5 | 0.7 | 5.0 | 80.1 | 84.6 | 25 | 13.4 |

EXAMPLE IV

The phosphate ore flotation in the series of tests was performed as outlined in Example III, supra except that the dosage of oleic acid in the carbonate flotation step was decreased to 0.25 kg per ton of feed. The flotation results are shown in Table IV infra. The recovered phosphate product contained 31.1 percent $P_2O_5$ and 0.8 percent MgO; the $P_2O_5$ recovery was 84.9 percent.

TABLE IV

| Product | Analysis, % | | | | | Distribution, % | | | |
|---|---|---|---|---|---|---|---|---|---|
| | Wt % | CaO | $P_2O_5$ | MgO | $SiO_2$ | CaO | $P_2O_5$ | MgO | $SiO_2$ |
| Rougher phospate flotation | 19.1 | 10.4 | 3.9 | 2.5 | 75.0 | 5.2 | 3.3 | 25 | 62.7 |
| Rougher sink | | | | | | | | | |
| Cleaner phosphate flotation | | | | | | | | | |
| First cleaner sink | 7.2 | 19.6 | 9.0 | 3.6 | 50.4 | 3.7 | 2.9 | 14 | 15.9 |
| Second cleaner sink | 3.7 | 27.1 | 14.1 | 3.7 | 40.9 | 2.7 | 2.3 | 7 | 6.7 |
| Phosphate-carbonate flotation | 22.3 | 47.4 | 29.8 | 1.0 | 7.9 | 27.7 | 29.1 | 12 | 7.7 |
| Phosphate concentrate I | | | | | | | | | |
| Carbonate flotation | | | | | | | | | |
| Carbonate float | 7.7 | 42.7 | 19.7 | 6.9 | 2.7 | 8.6 | 6.6 | 28 | 0.9 |
| Phosphate concentrate II | 39.9 | 49.8 | 31.9 | 0.7 | 3.5 | 52.1 | 55.8 | 15 | 6.1 |
| Head (Calculated) | 99.9 | 38.2 | 22.8 | 1.9 | 22.9 | 100.0 | 100.0 | 101 | 100.0 |
| Phosphate Product (Calculated) | 62.2 | 48.9 | 31.1 | 0.8 | 5.1 | 79.8 | 84.9 | 27 | 13.8 |

EXAMPLE V

In this series of tests the phosphate ore flotation was performed as outlined in Example III, supra except that the dosage of $H_2SO_4$ in the partial deoiling step was increased to the rate of 0.4 kg per ton of feed and the dosage oleic acid in the carbonate flotation step was decreased to 0.25 kg per ton of feed. The flotation results are shown in Table V infra. The recovered phosphate product contained 30.7 percent $P_2O_5$ and 0.9 percent MgO; the $P_2O_5$ recovery was 87.3 percent.

TABLE V

| Product | Analysis, % | | | | | Distribution, % | | | |
|---|---|---|---|---|---|---|---|---|---|
| | Wt % | CaO | $P_2O_5$ | MgO | $SiO_2$ | CaO | $P_2O_5$ | MgO | $SiO_2$ |
| Rougher phosphate flotation | 20.4 | 10.7 | 4.1 | 2.6 | 74.4 | 5.8 | 3.6 | 30 | 66.7 |
| Rougher sink | | | | | | | | | |
| Cleaner phosphate flotation | | | | | | | | | |
| First cleaner sink | 6.5 | 20.8 | 10.1 | 3.5 | 50.9 | 3.6 | 2.9 | 13 | 14.6 |
| Second cleaner sink | 3.7 | 28.9 | 15.3 | 3.8 | 34.4 | 2.8 | 2.5 | 8 | 5.6 |
| Phosphate-carbonate flotation | 42.7 | 47.5 | 30.4 | 0.9 | 5.2 | 53.7 | 56.5 | 22 | 9.8 |
| Phosphate concentrate I | | | | | | | | | |
| Carbonate flotation | | | | | | | | | |
| Carbonate float | 4.2 | 42.1 | 20.2 | 7.1 | 2.8 | 4.7 | 3.7 | 17 | 0.5 |
| Phosphate concentrate II | 22.5 | 49.5 | 31.4 | 0.9 | 2.8 | 29.5 | 30.8 | 11 | 2.8 |
| Head (Calculated) | 100.0 | 37.8 | 22.9 | 1.8 | 22.7 | 100.1 | 100.0 | 10 | 100.0 |
| Phosphate Product (Calculated) | 65.2 | 48.2 | 30.7 | 0.9 | 4.4 | 83.2 | 87.3 | 33 | 12.6 |

The results of Examples I to V, supra, are further summarized in Table VI infra, which indicates that the consumption of alkyl diphosphonic acid and oleic acid in the carbonate flotation step can be reduced by one-half or more using the present invention process (Examples III to V). The total consumption of sulfuric acid can also be reduced. The grade of concentrate and the $P_2O_5$ recovery are also improved slightly.

TABLE VI

| Example* | Kg Required/ton of feed | | | | | |
|---|---|---|---|---|---|---|
| | Diphosphonic | Oleic | Sulfuric | $P_2O_5$ | MgO | $P_2O_5$ Recovery |
| I | 0.15 | 1.5 | 1.5 | 30.4 | 0.8 | 81.4 |
| II | 0.15 | 1.0 | 1.5 | 30.3 | 0.9 | 85.7 |
| III | 0.075 | 0.38 | 0.8 | 30.5 | 0.7 | 84.6 |
| IV | 0.075 | 0.25 | 0.8 | 31.1 | 0.8 | 84.9 |
| V | 0.075 | 0.25 | 0.9 | 30.7 | 0.9 | 87.3 |

*Examples III to V are examples using the present invention.
Examples I and II are examples using prior art.

INVENTION PARAMETERS

After sifting and winnowing through the data herein presented as well as other results and operation of my novel process for beneficiation of phosphate ores containing coarse, weathered dolomite, the operating and preferred parameters and variables for flotation separation of the present invention are shown in the following tabulation.

| Variables | Tabulation of Parameters | |
|---|---|---|
| | Operating Range | Preferred Range |
| Feed size | −16 mesh +10 micron | −28 mesh +400 mesh |
| Rougher phosphate flotation | | |
| Conditioning pH | 8–11 | 8.5–10 |
| Conditioning density (solid) | 20–74% | 60–70% |
| Fatty acid (kg/ton) | 0.3–2 | 0.3–1.5 |
| Fuel oil | 0–4 | 0.2–3 |
| Cleaner phosphate flotation Reagents | 0 | 0 |
| Partial deoiling | | |
| $H_2SO_4$(kg/ton) | 0.05–0.5 | 0.1–0.4 |
| Pulp density (solid) | 5–65% | 15–35% |
| Phosphate-carbonate flotation Reagents | 0 | 0 |
| Total Deoling $H_2SO_4$ (kg/ton) | 0.07–0.7 | 0.2–0.5 |
| Carbonate flotation | | |
| Conditioning pH | 5–8 | 5–7 |
| Conditioning density (solid) | 20–74 | 30–70 |
| Diphosphonic acid (kg/ton) | 0.05–0.2 | 0.025–0.15 |
| Fatty acid (kg/ton) | 0.025–0.5 | 0.05–0.4 |

While I have shown and described particular embodiments of my invention, modifications and variations thereof will occur to those skilled in the art. I wish it to be understood, therefore, that the appended claims are intended to cover such modifications and variations which are within the true scope and spirit of my invention.

What I claim as new and desire to secure by Letters Patent of the United States is:

1. An ore beneficiation process which comprises the steps of:

(a) subjecting, within a pH ranging from about 8.0 to about 11 as rougher phosphate flotation feed, a phosphate ore containing coarse, weathered dolomite impurities to a rougher phosphate flotation step in the presence of from about 0.3 kg to about 2 kg of fatty acid and in amounts ranging upwards to about 4 kg of fuel oil, said weights of acid and oil based on each ton of said flotation feed;

(b) collecting substantially the phosphate values along with relatively small amounts of silica and significant amounts of said coarse, weathered dolomite impurities as phosphate rougher concentrate from the float and rejecting substantial amounts of the silica waste in the sink of step (a) supra;

(c) subjecting said phosphate rougher concentrate collected in step (b) supra to at least one cleaner flotation step to thereby reject substantial amounts of said coarse, weathered dolomite and residual silica in the sink thereof and recovering in the float therefrom phosphate cleaner concentrate;

(d) partially removing the fatty acid and fuel oil from said phosphate cleaner concentrate recovered in the float from step (c) supra by subjecting said concentrate to a partial deoiling step in the presence of from about 0.05 kg to about 0.5 kg of $H_2SO_4$ per ton of feed thereto;

(e) subjecting the resulting partially deoiled phosphate concentrate from step (d) supra to a phosphate-carbonate flotation step;

(f) collecting a predetermined portion of the phosphate values as a first intermediate product fraction as underflow in said phosphate-carbonate flotation in step (e) supra;

(g) collecting the float from the said phosphate-carbonate flotation in step (e) supra, and subjecting same to a total deoiling step in the presence of from about 0.07 to about 0.7 kg $H_2SO_4$ per ton of feed;

(h) subjecting the resulting totally deoiled phosphate concentrate from step (g) supra to a carbonate flotation step in the presence of from about 0.015 kg to about 0.2 kg of alkyl diphosphonic acid per ton of feed, and from about 0.025 kg to about 0.5 kg fatty acid per ton of feed added thereto;

(i) removing the resulting separated dolomite in the resulting float of step (h) supra;

(j) recovering as a second intermediate product fraction the resulting phosphate values in the sink of step (h) supra; and (k) combining said phosphate values recovered as said first and said second intermediate product fractions in step (f) and step (j) supra respectively as the final phosphate product;

said process characterized by the fact that no flotation reagents are added to steps (c) and (e) supra in addition to those that are carried thereover from step (a) supra.

2. The process of claim 1 wherein step (a) thereof said pH ranges from about 8.5 to about 10, said fatty acid ranges from about 0.3 kg to about 1.5 kg, and said fuel oil ranges from about 0.2 kg to about 3 kg; wherein step (d) thereof said sulfuric acid ranges from about 0.02 kg to about 0.5 kg; wherein step (g) thereof said sulfuric acid ranges from about 0.2 kg to about 0.5 kg; and wherein step (h) thereof said alkyl diphosphonic acid ranges from about 0.025 kg to about 0.15 kg and said fatty acid ranges from about 0.05 kg to about 0.4 kg.

* * * * *